US005971211A

United States Patent [19]

Farley et al.

[11] Patent Number: 5,971,211

[45] **Date of Patent: *Oct. 26, 1999**

[54] DISPENSER AND PLATEN FOR HEATING VISCOUS THERMOPLASTIC MATERIAL, SUCH AS HOT MELT ADHESIVES

[75] Inventors: Mark Harrison Farley, Simi Valley, Calif.; David R. Jeter, Woodstock, Ga.

[73] Assignee: Nordson Corporation, Westlake, Ohio

[ * ] Notice: This patent is subject to a terminal disclaimer.

[21] Appl. No.: 08/940,416

[22] Filed: Sep. 30, 1997

Related U.S. Application Data

[63] Continuation-in-part of application No. 29/060,508, Sep. 30, 1996, Pat. No. Des. 387,075.

[51] Int. Cl.[6] ..... B67D 5/62

[52] U.S. Cl. ..... 222/146.5; 222/386

[58] Field of Search ..... 222/146.5, 260, 222/261, 386; 219/421, 214; D15/144.2

[56] References Cited

U.S. PATENT DOCUMENTS

| | | | |
|---|---|---|---|
| D. 387,075 | 12/1997 | Farley | D15/144.2 |
| 2,478,893 | 11/1949 | Brant . | |
| 2,630,248 | 10/1953 | Hinz . | |
| 3,282,469 | 11/1966 | Skonberg . | |
| 3,412,903 | 11/1968 | Riper, Jr. et al. . | |
| 3,546,430 | 12/1970 | Kane . | |
| 3,637,111 | 1/1972 | McCreary . | |
| 3,758,003 | 9/1973 | Kautz et al. . | |
| 3,976,229 | 8/1976 | Jackson . | |
| 3,982,669 | 9/1976 | Moore . | |

(List continued on next page.)

FOREIGN PATENT DOCUMENTS 0901981 3/1999 European Pat. Off. .

OTHER PUBLICATIONS

Meltex® Drum Melter DG 21, Meltex Corp. (published on or before 1989).
Meltex® Information Drum Melters, Meltex Corp. (published on or before 1989).
Nordson® Series 5000 Drum Melters Options (Publication, Issued Feb. 1992), Nordson Corp.
Meltex® Drum Unloader DP 201, Meltex Corp. (published on or before 1989).
UNIflow®Platen Options.
Meltex® Hydraulic Drum Melter DG 201 H, Meltex Corp. (published on or before 1989).
Meltex® Drum Melter DG 201, Meltex Corp. (Feb. 1991).
Meltex® Information Faβschmelzer, Meltex Corp. (1986).
Uniflow® Fibre Drum Unloader; Mercer Corporation.

(List continued on next page.)

*Primary Examiner*—Philippe Derakshani
*Attorney, Agent, or Firm*—Wood, Herron & Evans, L.L.P.

[57] ABSTRACT

An apparatus used in a system for liquefying and dispensing a hot melt adhesive from a container to a substrate using an improved platen with fins to help guide the hot melt adhesive to a pump. The fins consist of primary, secondary, tertiary, and perimeter fins. The primary fins of the platen extend from the outer periphery radially inward to the center of the platen. The secondary fins are interposed between the pairs of primary fins, and the tertiary fins are interposed between each pair of primary and secondary fins. Both the secondary and tertiary fins taper to provide for a gradual pressure drop along their radial extent to provide for a better fluid flow. The perimeter fins, which are located radially inward along the outer circumference of the platen, provide for an increased surface area at the outer edges of the platen. A pair of elastomeric seals provides a fluid tight seal between the platen and the container of hot melt material. The seals are located as close to the lower portion of the platen to allow for more adhesive in the container and therefore less space at its opening.

22 Claims, 10 Drawing Sheets

U.S. PATENT DOCUMENTS

| | | |
|---|---|---|
| 4,073,409 | 2/1978 | Gardner et al. . |
| 4,090,640 | 5/1978 | Smith et al. . |
| 4,195,755 | 4/1980 | Slautterback et al. . |
| 4,227,069 | 10/1980 | Gardner et al. . |
| 4,632,277 | 12/1986 | Pallente . |
| 4,661,688 | 4/1987 | Gabryszewski . |
| 5,148,947 | 9/1992 | Epp et al. . |

OTHER PUBLICATIONS

DM–55P Bulk Unloader/Dispenser System; LTI Corporation (Aug. 1982).

LTI's DM55 Drum Unloader/Dispenser; LTI Corporation.

Dynamelt® 5; Portable Hot Melt Unloader/Dispenser; Graco LTI.

Dynamelt® DM–55 Hot Melt Unloader/Dispenser; Graco LTI.

Nordson®Bulk Melter Systems (Issued Sep. 1990), Nordson Corporation.

Nordson® Bulker Melt/Applicators (Issued Jul. 1979), Nordson Corporation.

Nordson® Product Information, Model 5505 Bulk Melter/Applicator (Issued 1981–82); Nordson Corporation.

Nordson® Model 5505 & Model 5510 Bulk Melter/applicator Systems (Issued May 1980) Nordson Corporation.

DISPENSER AND PLATEN FOR HEATING VISCOUS THERMOPLASTIC MATERIAL, SUCH AS HOT MELT ADHESIVES

RELATED APPLICATIONS

This application is a continuation-in-part of U.S. patent application Ser. No. 29/060,508 filed on Sep. 30, 1996 now U.S. Pat. No. No. D387,075.

BACKGROUND OF THE INVENTION

This invention relates to the heating and melting of thermoplastic material from bulk containers. More particularly, this invention relates to the heating and melting of thermoplastic materials, such as hot melt adhesives, from containers, such as 55-gallon drums, 5-gallon pails, etc., such that the liquefied material may be pumped from the container for subsequent use by other application equipment.

There are a number of hot melt dispensers which liquefy and dispense thermoplastic materials, such as hot melt adhesives, which permit dispensing the material directly from the shipping container (drum, barrel, pail, etc.). One such common device includes an arrangement in which a heated element is lowered directly into the open end of the container for liquefying or melting the thermoplastic material in the region directly below this heating element. Typically the heated element is a heated platen for liquefying the material so that a pump may pump the liquefied material to equipment for dispensing the material onto a substrate. Such apparatus would include those shown in U.S. Pat. Nos. 3,412,903; 3,637,111; 4,227,069; 4,195,755; and 4,661,688, as well as the Meltex® DG-21 and DG-201, and the Nordson 500 Series and 5500 Series Drum Melters.

Commonly, the dispensing apparatus includes a heated follower plate assembly, or platen assembly, which includes a pair of gaskets about its periphery, a pump for pumping the liquefied material and a lower heated section. When the lower heated section is placed within the container the lower heated section liquefies the thermoplastic material for delivery through suitable passageways to the inlet of the pump. Typically, the lower portion of the follower plate or platen comprises a number of segments, which are heated and are releasably attachable to the plate. Finally, either a platform may be provided by means of which the container is elevated or a mechanism may be provided by which the plate assembly is lowered into the container. The lower heated segments of the plate or platen may be smooth or they may be finned in design. Typically, the flat heated surfaces are useful for liquefying material in which a demand or melting rate of the material is low while the finned design is used in those instances where higher melt temperatures and/or greater flow rates are required.

In operation, the platen is inserted into the container. 0-ring seals, or gaskets, come into contact with the inner peripheral surface of the container which contains the adhesive. The container is not filled to capacity because the gaskets must first come into contact with the container to form a proper seal in which to remove the material. By positioning the gaskets at the lower portion of the platen the amount of unfilled space at the top of the container is minimized. This positioning allows the container to be filled with more material and leads to better overall use of the container.

SUMMARY OF THE INVENTION

The invention disclosed is an apparatus used in a system for liquefying and dispensing a hot melt adhesive from a container to a substrate. The system comprises a pump for pumping the liquefied hot melt adhesive and a platen. The apparatus comprises a platen having a top portion, a bottom portion, a center, an outer periphery, an inner surface, a radius, and a hub portion. The hub portion is located substantially about the center of the platen.

The bottom portion of the platen has primary fins and secondary fins. The primary fins have a base and extend from the outer periphery radially inward to the center of the hub portion of the platen.

The secondary fins are interposed between each adjacent pair of primary fins. The secondary fins have a first portion, a second portion, and a base. The first portion of the secondary fins have a first inner end. The first portion of the secondary fins begins at the outer periphery of the platen and extends radially inward to the first inner end. The first inner end of the secondary fins extends radially inward from the outer periphery of the platen to a length between sixty (60) and ninety (90) percent of the radius of the platen. The second portion has a second inner end. The second portion begins at the first inner end and extends to the second inner end. The second portion of the secondary fins have a taper. The taper extends inwardly from the first portion of the secondary fin to the inner surface of the platen.

The secondary fins also have a first sidewall, a second sidewall, and a base. The first sidewall has a first base portion. The first base portion extends from the inner surface of the platen to the top of the second portion of the secondary fins. The first sidewall tapers radially inwardly in both the radial and outward directions.

The bottom portion of the platen can also comprise tertiary fins. The tertiary fins are interposed between each adjacent pair of primary and secondary fins. The tertiary fins have a first portion, a second portion, and a base. The first portion has a first inner end. The first portion of the tertiary fins begins at the outer periphery of the platen and extends radially inward to the first inner end. The first inner end of the tertiary fins extends radially inward from the outer periphery of the platen to a length between forty (40) and seventy (70) percent of the radius of the platen. The second portion has a second inner end. The second portion begins at the first inner end and extends to the second inner end. The second portion of the tertiary fins have a taper. The taper extends inwardly from the first portion of the tertiary fin to the inner surface of the platen. The tertiary fins also have a first sidewall, a second sidewall and a base.

The first sidewall of the tertiary fms has a first base portion. The first base portion extends from the inner surface of the platen to the top of the second portion of the tertiary fins. The first sidewall tapers radially inwardly in both the radial and outward directions.

The bases of the primary, secondary, and tertiary fins are radiused. The primary, secondary and tertiary fins are spaced apart from each other by a distance equal to, or greater than, the melt layer thickness of the hot melt adhesive.

An alternative embodiment of the disclosed invention is the presence of perimeter fins. The perimeter fins extend radially within the platen.

The platen further comprises a cylindrical sidewall and a pair of elastomeric seals. The cylindrical sidewall has a pair of peripheral grooves. The pair of peripheral grooves accepts the pair of elastomeric seals, wherein the pair of peripheral grooves nest above the perimeter fins.

DETAILED DESCRIPTION OF THE PREFERRED EMBODIMENT OF THE INVENTION

Figure 1:
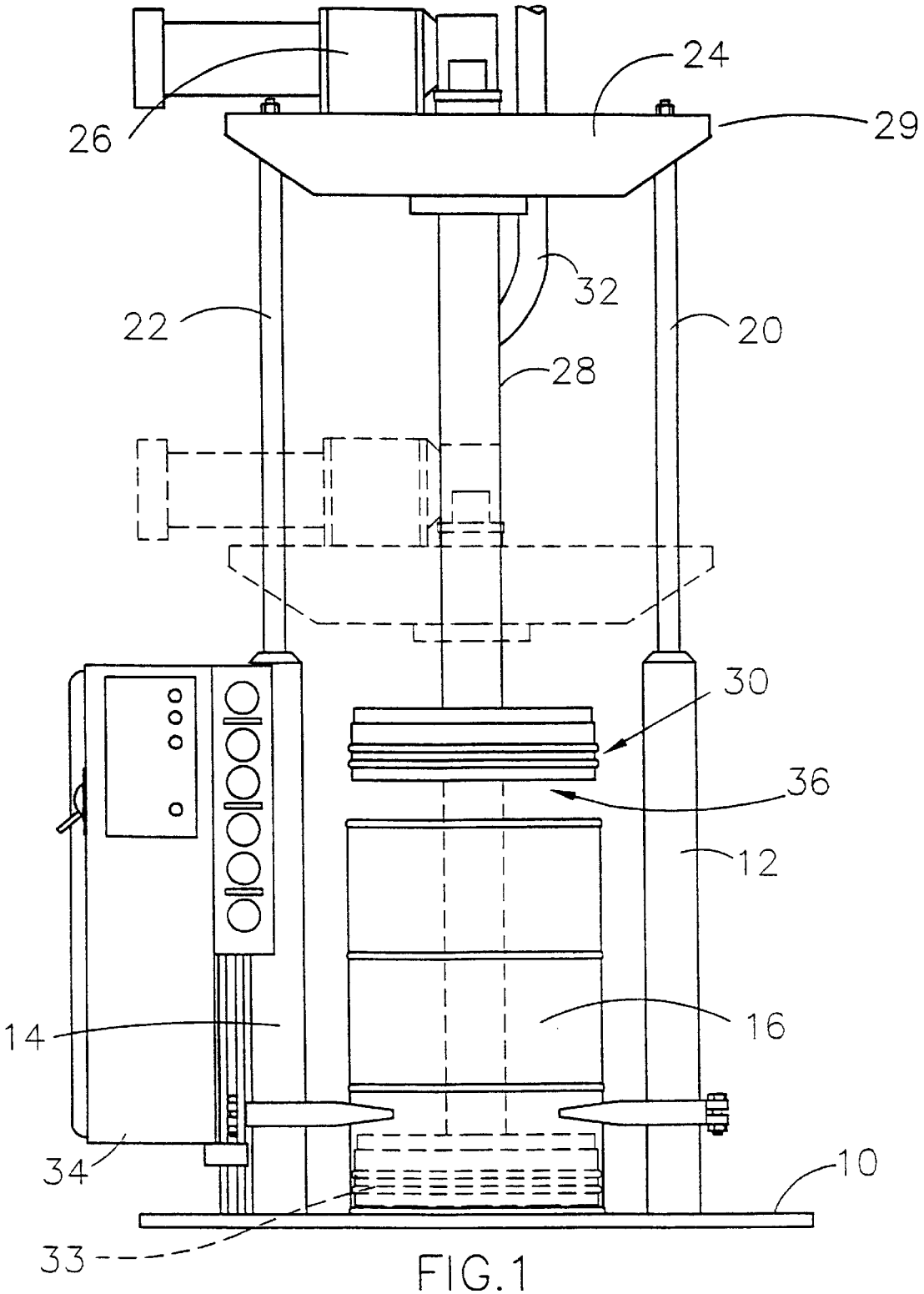
FIG. 1 is a front view of a hot melt pumping and dispensing apparatus in accordance with one aspect of this invention.

Referring first to FIG. 1, there is illustrated an apparatus for heating and melting thermoplastic materials from a bulk container, such as in drums, cans, etc. In particular, the apparatus of FIG. 1 is especially suitable for the heating and liquefying to a pumpable condition hot melt adhesives so that the hot melt adhesive may be subsequently dispensed onto a substrate by other application equipment (not shown). The apparatus includes a base plate 10 on which are supported a plurality of uprights, such as a pair of upright support cylinders 12 and 14. The base plate 10 may also support a drum 16, such as a 55 gallon drum, of hot melt material from which the material is to be removed.

A pair of cylinder rods 20 and 22 extends upwardly, respectively, from support cylinders 12 and 14. A crosshead member 24 joins the cylinder rods 20 and 22 at their upper ends. Crosshead member 24 may also support a pump drive motor assembly 26 as well as a tube or pipe 28.

A platen, indicated generally at 30, is attached to one end of the tube 28 such that the platen 30 may be raised or lowered into the drum 16. The platen 30 is shown in the raised or elevated position in FIG. 1 prior to being inserted into the drum 16. Pressurized air may be admitted into the support cylinders 12 and 14 to cause the cylinder rods 20 and 22 to extend from the support cylinders 12 and 14 to cause the crossheads member 24 and the associated structure supported thereon to be raised to an elevated position, such as for example as shown in FIG. 1 at 29. Similarly, pressurized air may be applied to the support cylinders 12 and 14 to cause the cylinder rods 20 and 22 to retract, and in turn cause the crosshead member 24 to move downwardly. This, in turn, causes the platen 30 to be inserted into the drum 16 so as to apply a force or pressure against the hot material in the drum 16. With the platen 30 inserted into the opening of the drum 16, the platen 30 will begin to heat the hot melt material contained within the drum 16 until it is in a liquefied pumpable condition whereupon the material may be pumped from the drum 16 via conduit or hose 32 for subsequent use by downstream equipment. As more and more material is removed from the drum 16, the platen 30 may continue to be inserted into the drum 16 until the platen 30 is at the bottom of drum 16, shown generally at 33 in phantom. Additionally, an electrical control panel 34 may be supported on the base plate 10 for providing the controls, including the temperature monitoring controls, necessary in the operation of the apparatus of FIG. 1.

Figure 5:
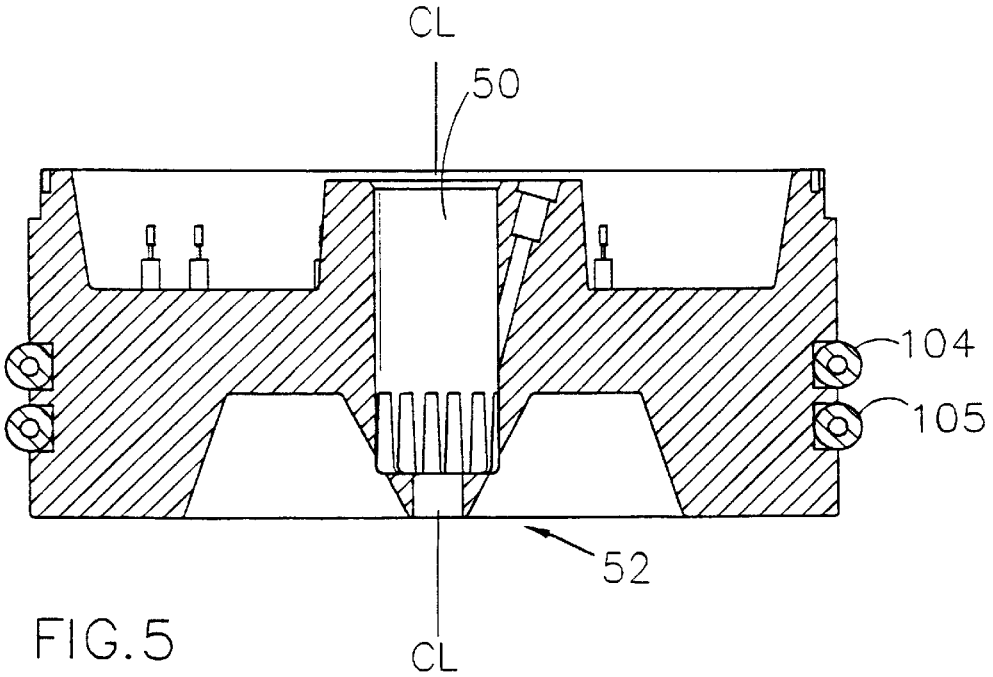
FIG. 5 is a cross-sectional view of the platen taken substantially along the line of 5—5 of FIG. 3.
Figure 6:
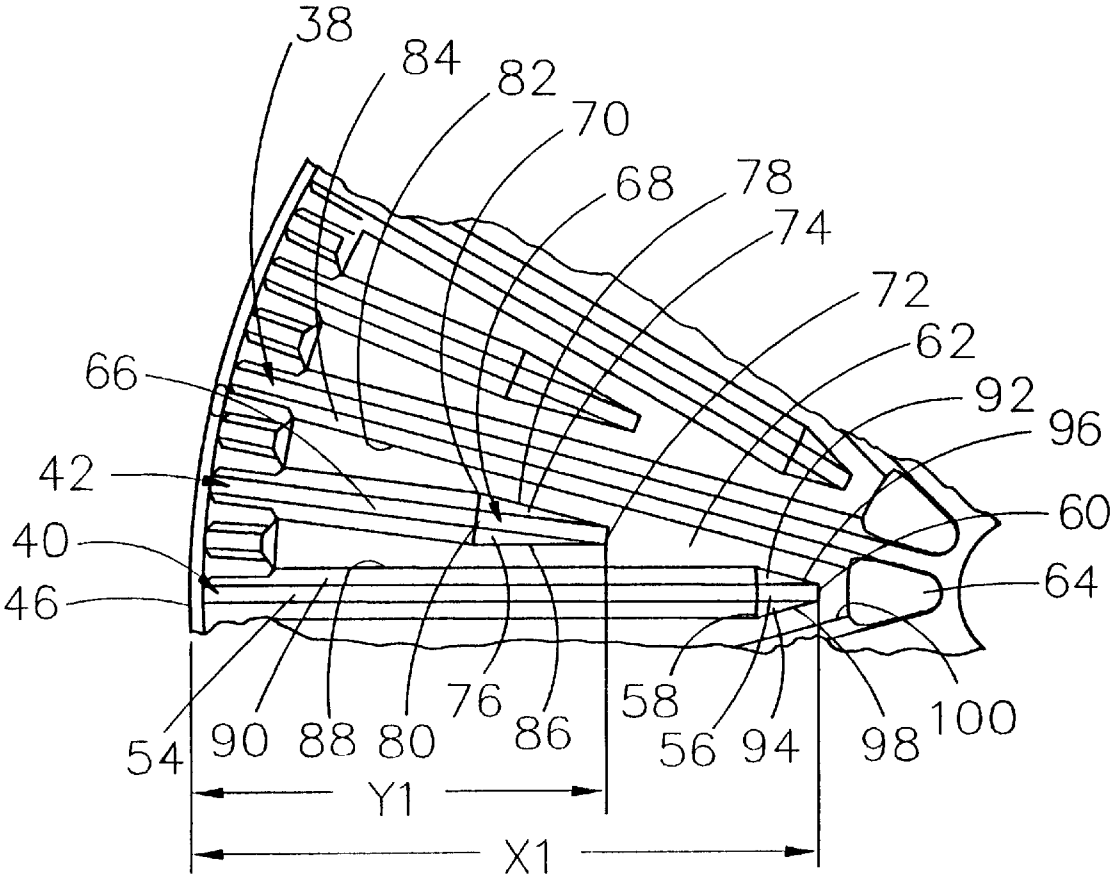
FIG. 6 is an edged fragmentary portion of FIG. 3.
Figure 7:
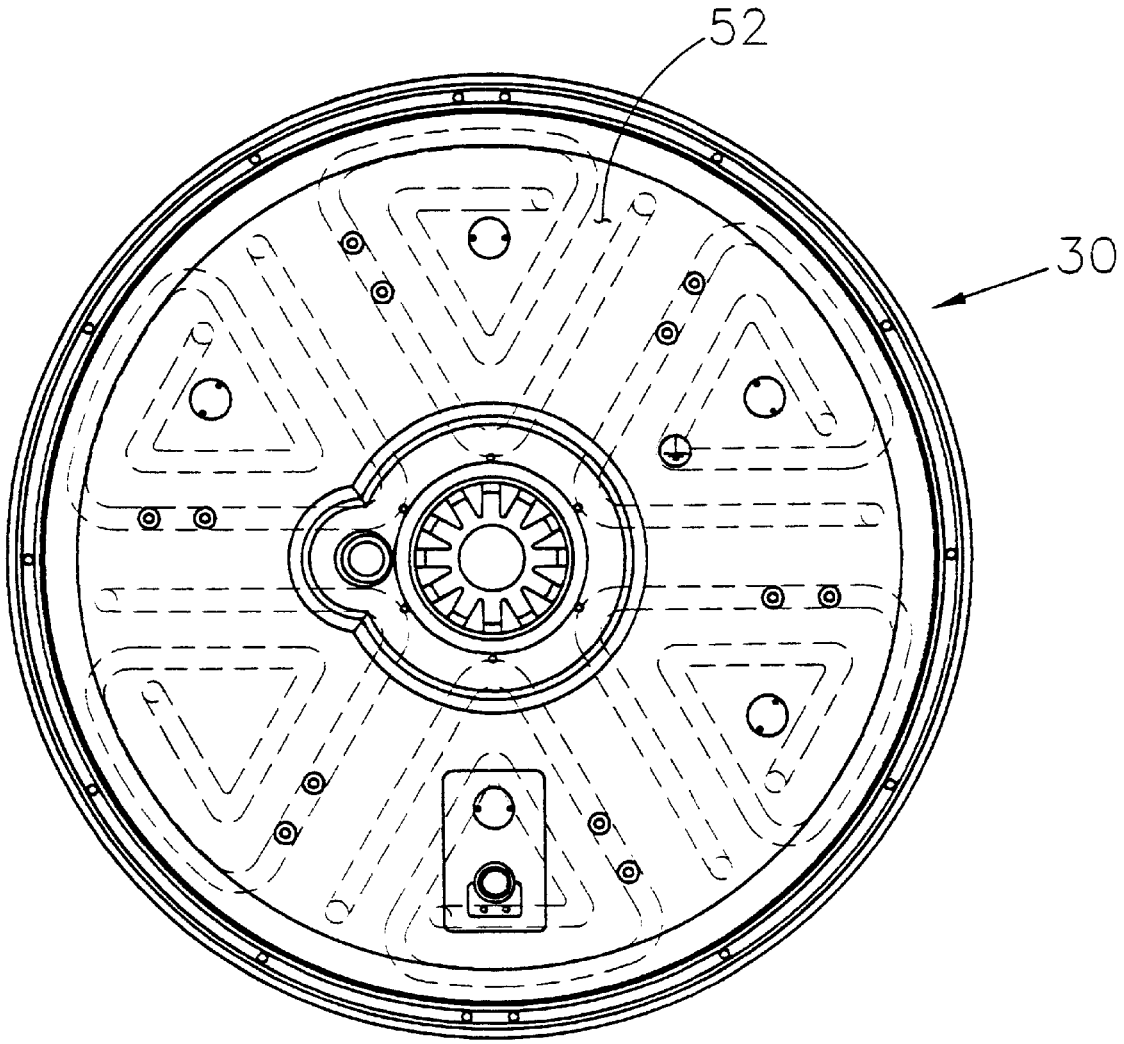
FIG. 7 is the top plan view of the platen, when oriented in its normal position of operation such as illustrated in FIG. 1.
Figure 8:
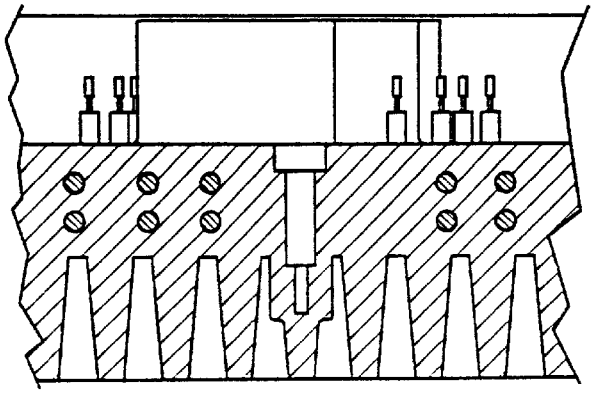
FIG. 8 is a cross-sectional view of the platen taken substantially along the line 8—8 of FIG. 3.
Figure 9:
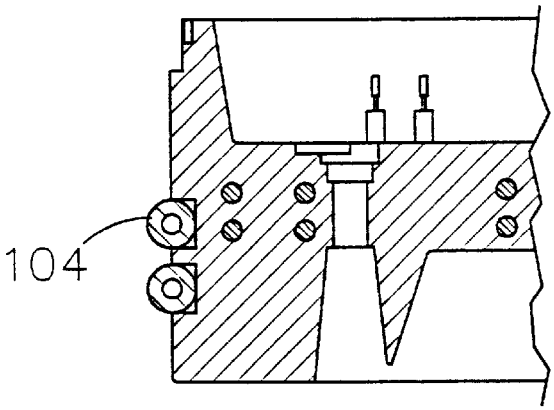
FIG. 9 is the cross-sectional view of the platen taken along the line of 9—9 of FIG. 3.
Figure 10:
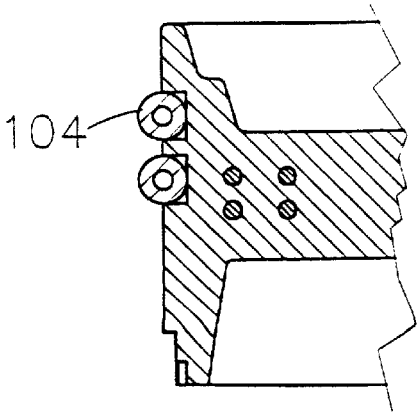
FIG. 10 is a cross-sectional view of the platen taken along the line 10—10 of FIG. 3.

Referring to FIGS. 1–7, the platen 30 will be discussed in greater detail. In operation, the platen 30 includes a surface for engaging or coming in contact with the hot melt material, shown generally as reference numeral 36, so that the hot melt material may be heated and liquefied to a pumpable condition. In operation, such as the example depicted in FIG. 1, this portion of the platen 30 would correspond to the lowermost portion or the bottom 36 of the platen 30. As shown in FIG. 7, the platen 30, in its preferred embodiment, has six heating units 51 which are arranged in a triangular configuration. The heating units 51 are typically three phase power heating units. The heating units 51 shown in FIG. 7 are identical to one another and are spaced apart uniformly about the platen 30. Different heating units 51 could be used which are smaller in shape and which would allow more units 51 to be used with the platen 30.

The bottom portion 36 of the platen 30 comprises a plurality of fins. These fins include primary fins 38, secondary fins 40, and tertiary fins 42.

Figure 2:
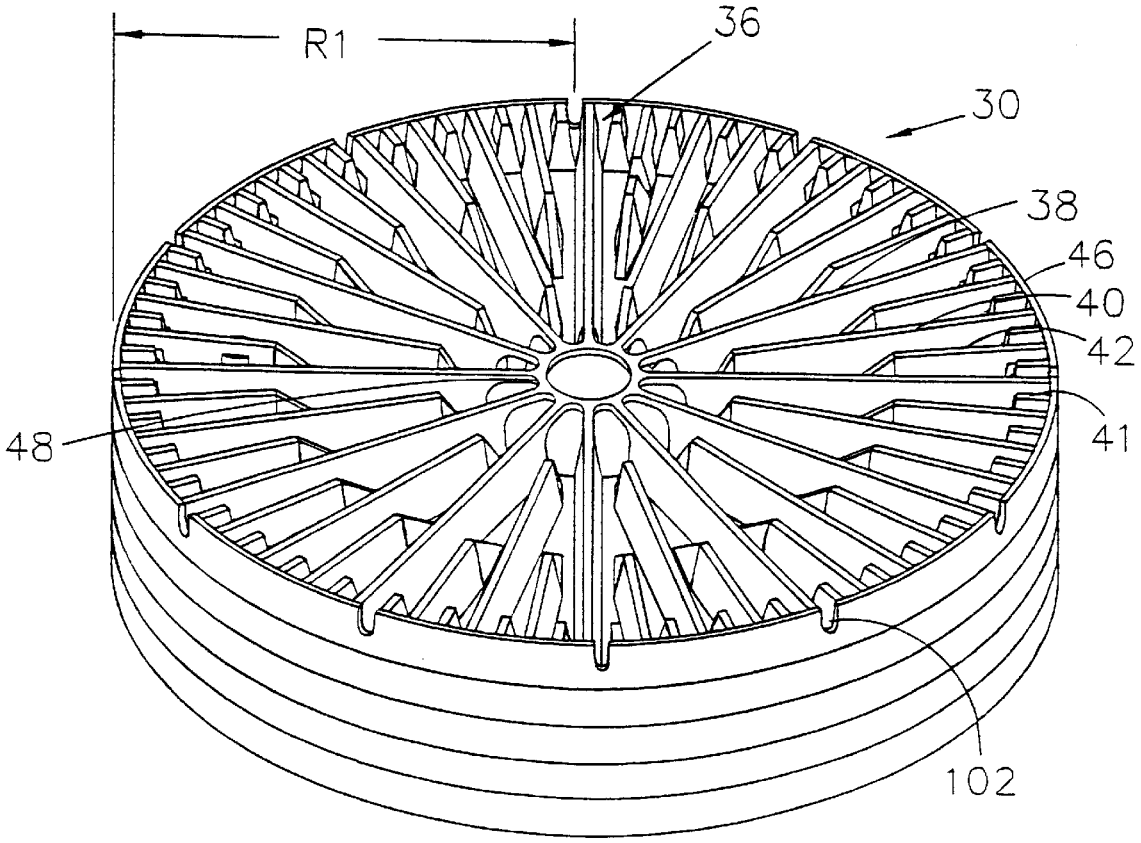
FIG. 2 is a bottom, perspective view of the platen assembly, as oriented in FIG. 1, and in which the seals have been omitted for clarity, which when inserted into a drum will come in contact with the material to be liquefied.
Figure 3:
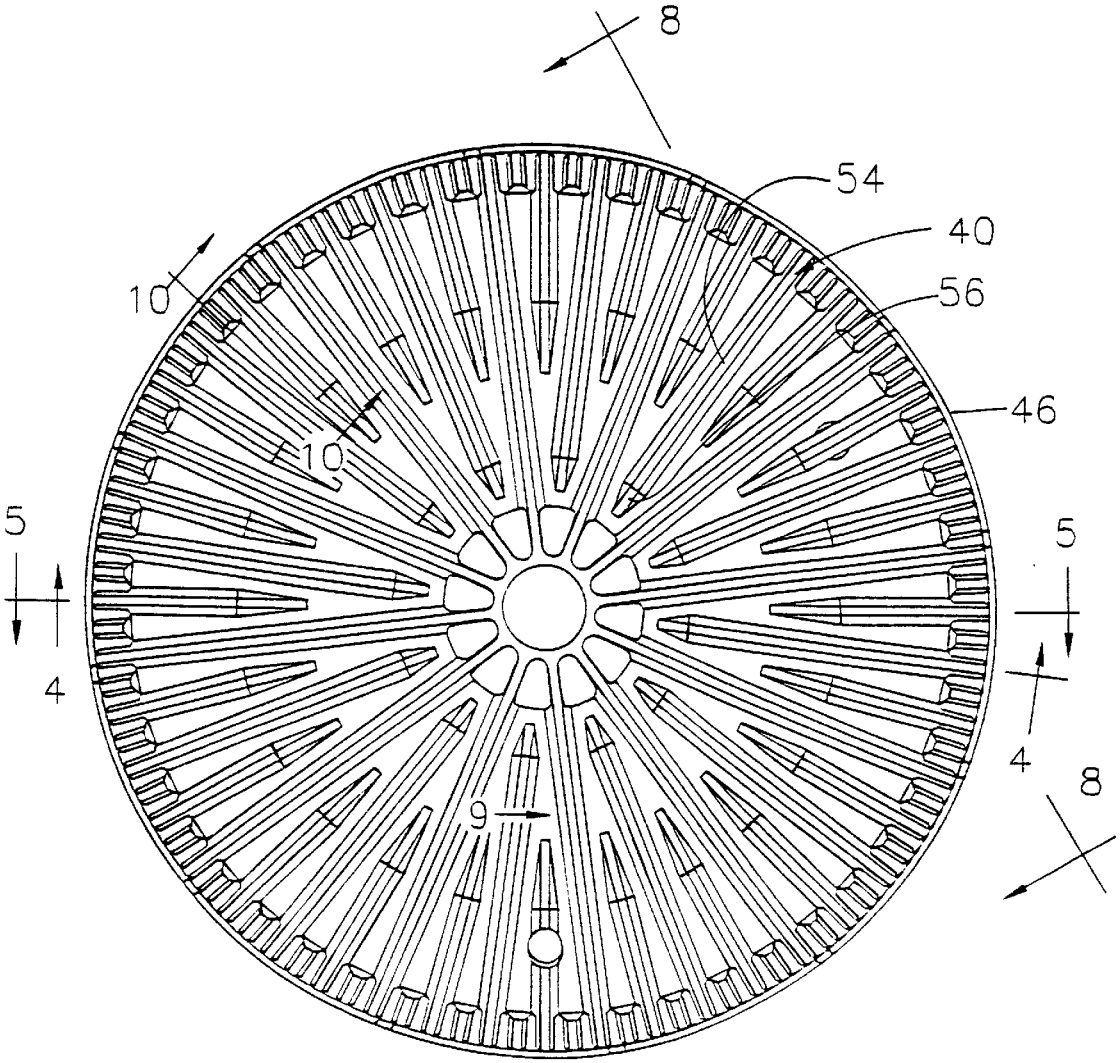
FIG. 3 is the plan view of the bottom of the platen, when oriented in its normal course of operation of the device of FIG. 1.
Figure 4:
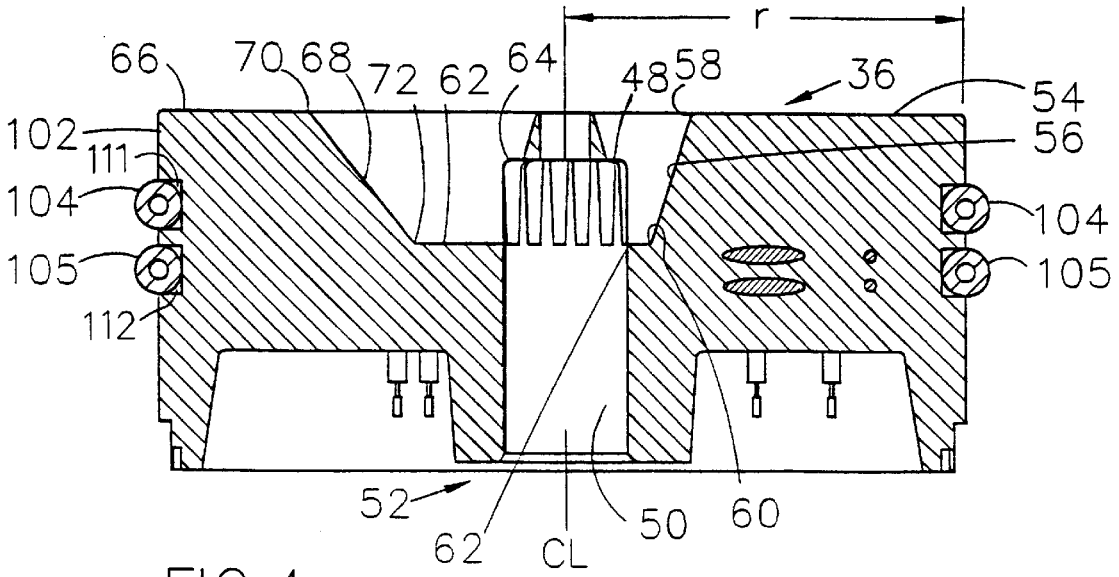
FIG. 4 is a cross-sectional view of the platen taken along the line 4—4 of FIG. 3.

As shown in FIG. 2, each primary fin 38 extends from the outer periphery 46 radially inwardly to a central hub portion 48. The central hub portion 48 is located substantially about the center of the platen 30 and is concentric with a centerline CL of the platen 30. Interposed between each pair of adjacent primary fins 38 is a secondary fin 40. Disposed between each adjacent pair of primary 38 and secondary fins 40 is a tertiary fin 42. The hub portion 48 includes a through bore 50, as shown in FIG. 5, extending from the bottom portion 36 of the platen 30 to the top or upper face 52. The through bore 50 may be a stepped bore wherein the smaller diameter portion extends from the bottom portion 36 of the platen 30. The primary fins 38 help keep the center of the platen 30 at an even temperature by extending radially inward to the central hub portion 48.

Figure 11:
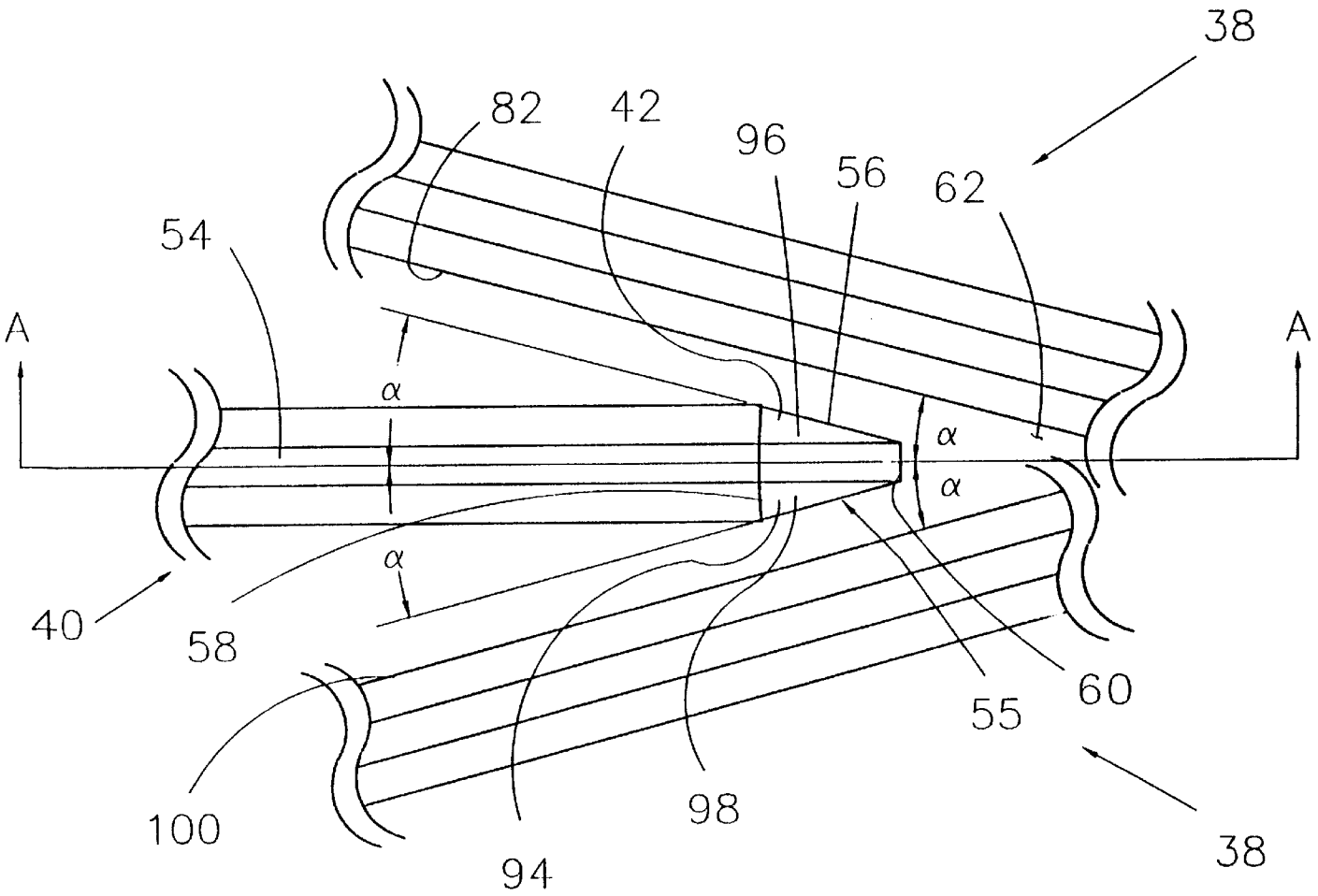
FIG. 11 is a top view showing the arrangement of a secondary fin between two primary fins.

FIG. 2 shows secondary fins 40. Each secondary fin 40 has a first portion 54 and a second portion 56, as is best shown in FIG. 6 and FIG. 11. The first portion 54 begins at the outer periphery 46 of the platen 30 and extends radially inwardly to a first inner end 58. The second portion 56 of the secondary fin 40 extends from the first radially inner end 58 of the first portion 54 to a second radially inner end 60. The second portion 56 of the secondary fin 40 has a taper 55 which tapers inwardly from the radially inner end 58 to the inner platen surface 62. Preferably, the second inner end 60 of the second portion 56 of the secondary fin 40 is located from the outer periphery 46 a distance X1, with X1 being between 60% and 90% of the length of radius R1 of the platen 30.

Figure 12:
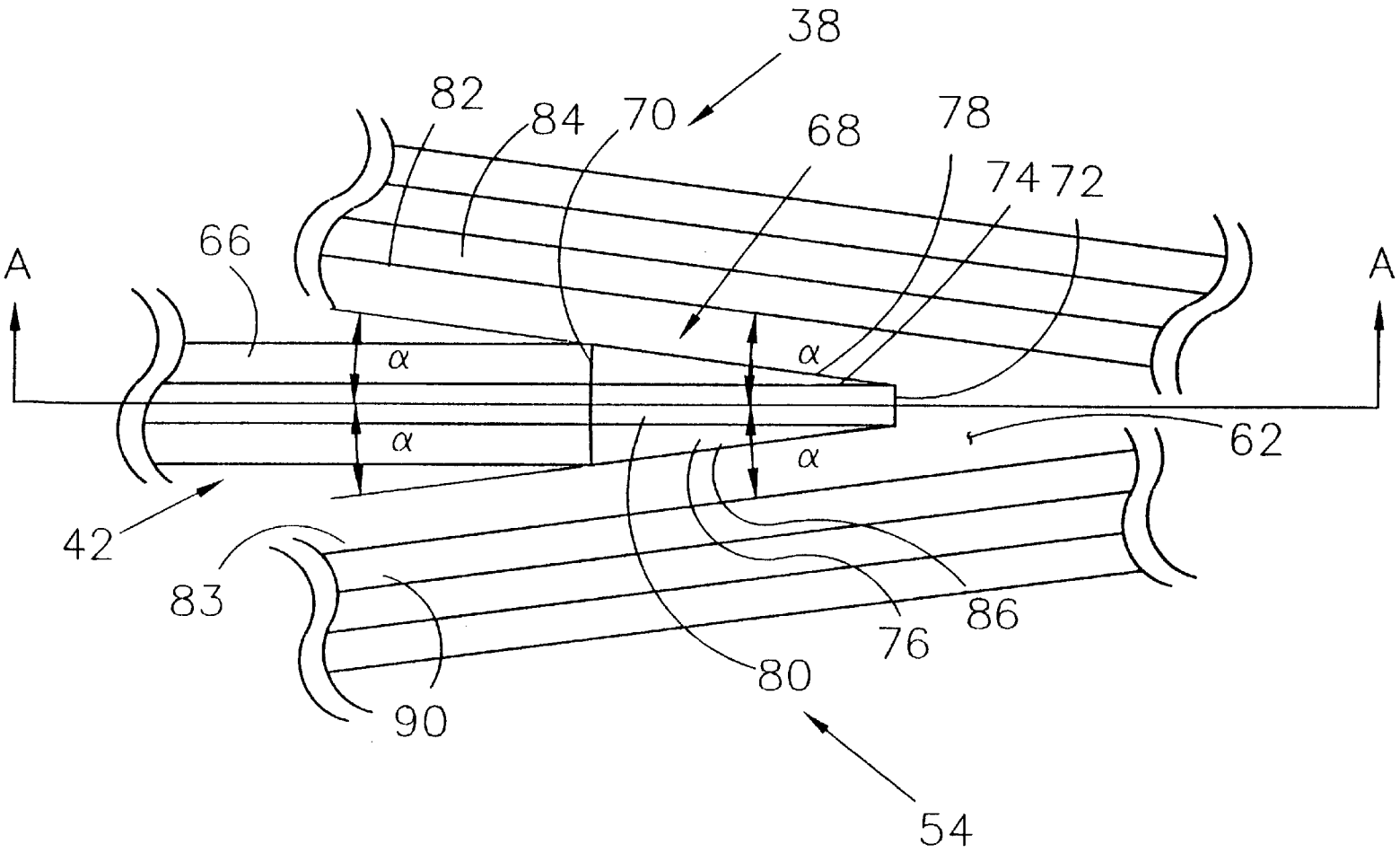
FIG. 12 is a top view showing the arrangement of a tertiary fin between a primary fin and a secondary fin.

The platen 30 also includes tertiary fins 42. As shown in FIGS. 6, 12, the tertiary fin 42 is disposed between each adjacent pair of primary fins 38 and secondary fins 40. Each tertiary fin 42 has a first portion 66 and a second portion 68. The first portion 66 begins at the outer periphery 46 of the platen 30 and extends radially inwardly to a first inner end 70. Preferably, the height H1 of the first portion 66 of the tertiary fin 42 and the height H2 of the first portion 54 of the secondary fin 40 are between 75% and 125% of the height H3 of the primary fin 38. In the preferred embodiment, the height H1 of the first portion 66 of the tertiary fin 42 and the height H2 of the first portion 54 of the secondary fin 40 is equal to the height H3 of the primary fin 38.

The second portion 68 of the tertiary fin 42 extends from the first radially inner end 70 of the first portion 66 to a second radially inner end 72. The second portion 68 of the tertiary fin 42 has a taper which tapers inwardly from the first inner end 70 of the tertiary fin 42 to the inner surface 62 of the platen 70 at its second inner end 72, similarly to that of the second portion 56 of the secondary fin 40. Preferably, the first inner end 70 of the second portion 68 of the tertiary fin 42 is located a distance Y1 from the outer periphery 46. The distance Y1 is between 40% and 70% of the radius R1 of the platen 30.

The second portion 56 of the secondary fin 40 provides for a gradual pressure drop along its radial extent. This provides for a smooth transition of fluid flow as the liquefied material migrates radially inwardly to the adhesive collection orifices 64 carried by the hub 48. An adhesive collection orifice 64 is located between each pair of primary fins 38 and coupled to the through bore 50 of the hub. While providing this smooth pressure transition or drop, a better fluid flow is obtained, as opposed to prior art designs which did not include a taper and in which the fin extended roughly perpendicular from the inner surface 62 of the platen 30 at its inner end.

It is preferred that the minimum spacing between any of the primary 38, secondary 40 or tertiary 42 fins be no less than the melt layer thickness of the material to be liquefied and removed from the container 16. For typical packaging grade adhesives, this melt layer thickness minimum distance between fins would generally be in the range from about 0.125 inches to 0.25 inches (3.18 mm to 6.35 mm). Preferably, this minimum spacing would be about 0.1875 inch (4.76 mm). Ideally however, the fins 40, 42 should be spaced at about two times the melt layer thickness to provide good fluid flow, as well as to maintain a proper pressure differential between the pump inlet (not shown) and the platen 30.

Figure 13:
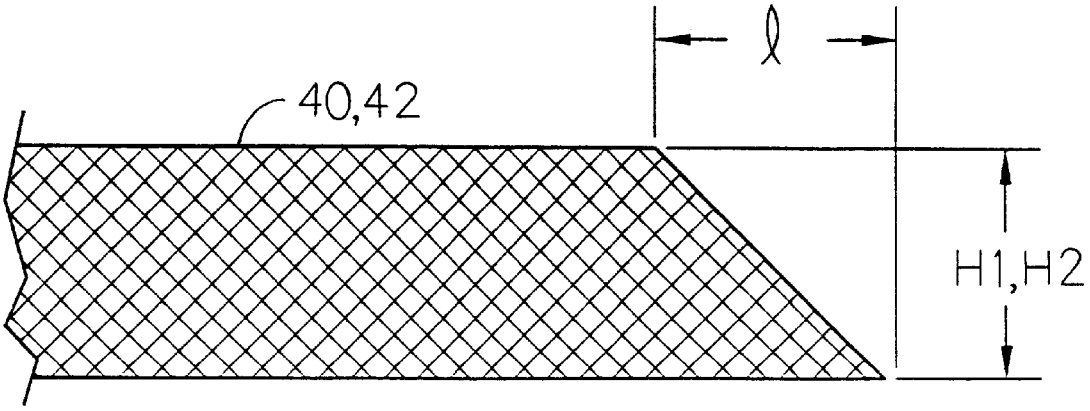
FIG. 13 is a cross-sectional view of a secondary or tertiary fin along the line A—A of FIG. 11 or 12.

Preferably, the first portions 54, 66, of the secondary 40 and tertiary 42 fins, as well as the primary fins 38, are substantially trapezoidal in cross-section. A typical cross-section is shown in FIG. 13. These cross-sections are substantially equal from one another and constant in the radial direction.

The second portion 68 of the tertiary fm 42 includes a pair of sidewalls 74, 76. Sidewall 74 extends from its base 76 at the inner surface 62 of the platen 30 to a top surface 80 of the second portion 68. The base 78 is parallel to the base portion 82 of the sidewall 84 of the adjacent primary fin 38. Similarly, the base portion 86 of side wall 76 is parallel to the base portion 88 of the side wall 90 of the adjacent first portion 54 of the adjacent secondary fin 40. Thus, the sidewalls 74, 76 taper radially inwardly in both the radial, as well as the outwardly direction. The second portion 68, therefore, also has a substantially trapezoidal cross-section, however the cross-sectional area reduces radially inwardly.

Similarly, the side walls 92, 94 of the second portion 56 of the secondary fins 40 taper inwardly both in the radial and the outward directions such that the base portions 96, 98 of the respective side walls 92, 94 are parallel to the adjacent base portions 82, 100 of the adjacent primary fins 38. Thus, the second portion of the secondary fins 40 also has a trapezoidal cross-section that reduces in area from the inner end 58 of the first portion 54 to its radial inner end 60.

With reference to FIG. 2, perimeter fins 38 are located radially inward along the circumference of the platen 30. The perimeter fins 38 transfer heat from interior regions of the platen 30 to the radial outer edges of the container 16. The perimeter fins 38 provide for an increased surface area at the outer edges of the platen 30, thereby increasing the heat transfer. In addition, the perimeter fins 38 compensate for heat loss to the adjacent areas by this increase in surface area. In the preferred embodiment, where the heights H1, H2, and H3 of the primary, secondary and tertiary fins are equal, the height of the perimeter fins 38 are preferably 50% of heights H1, H2 and H3. However, the height of the perimeter fins can vary from 25% of the heights H1, H2 and H3 to being equal to (i.e., 100%) the heights H1, H2 and H3. Where the heights H1, H2, and H3 are unequal, the height of the perimeter fins can vary from 25% to 100% of the height of the primary fin H1. In addition, the height of the perimeter fins can differ from one another within the same range of 25% to 100% of the primary fin height H1.

Figure 14:
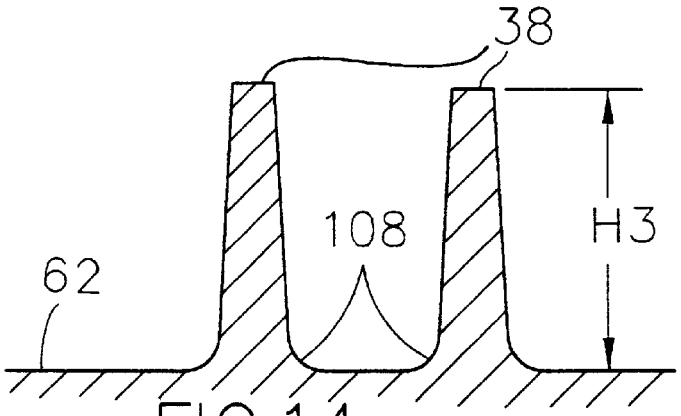
FIG. 14 is a frontal view of the fins showing the base portions having a maximized radius at the transitional area where the fins meet the lower portion of the platen face; and, FIG. 15 is a cross-sectional view of a fin showing the maximized radius along its base portion.
Figure 15:
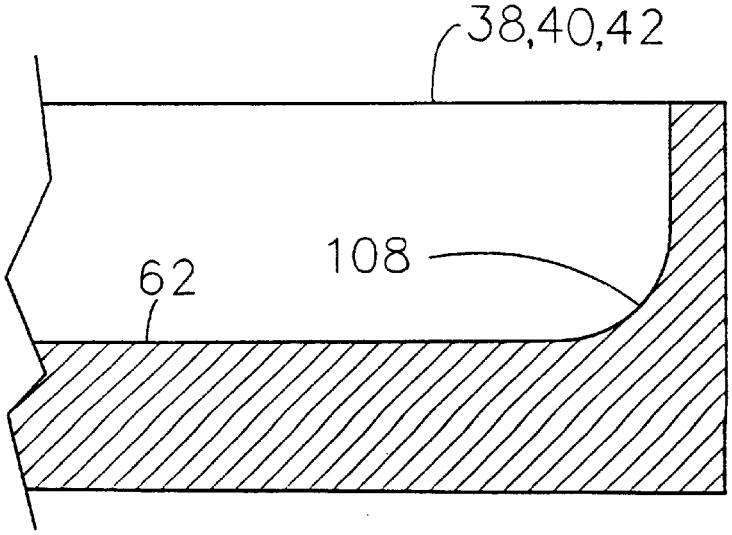

FIGS. 14 and 15 show the inner platen surface 62 as it extends into the fins 38, 40, and 42. Providing a radiused portion 108 maximizes the transitional area of the flow path. This radiused portion 108 at the bases of the respective fins 38, 40 and 42 minimizes the viscous drag, char, and the volume of uncirculated material, or "dead spots". This maximizes the flow of material through the finned platen 30 as well as minimizing "dead spots". "Dead spots" are areas where the material does not flow smoothly primarily due to charring. The flow of material becomes restricted due to clumps of small masses of material.

A cylindrical side wall 102 is formed with a pair of peripheral grooves 111, 112, that respectively accept a first elastomeric seal 104 and a second elastomeric seal 105. The seals 104, 105 engage the inside walls of the drum 16 to provide a fluid tight connection. The seals 104, 105 are located such that the inner surface 62 is located inwardly such that the seals 104, 105 nest into the platen 30 above the cantilevered section containing the perimeter fins 38. The perimeter fins 38 help to provide a path through the adhesive for the seals 104, 105 to follow by melting the adhesive ahead of the seals 104, 105. It is important for the location of the seals 104, 105 are located as close to the lower portion 36 of the platen 30 as possible. This allows the container 16 to have less space at its opening. The container 16 is thereby able to contain more adhesive. The container 16 must have some portion at the top to allow for the insertion of the platen 30 so that the seals 104, 105 can become engaged with the side of the container 16. Ideally, the fins contact the surface of the adhesive at the same time the seals 104 engage with the interior of the container 16.

I claim:

1. An apparatus used in a system for liquefying and dispensing a hot melt adhesive from a container to a substrate, the apparatus comprising:

a platen, said platen having a top portion, a bottom portion, a center, an outer periphery, an inner surface, a radius R1, and a hub portion, said hub portion located substantially about said center of said platen, said bottom portion having first and second primary fins and at least one secondary fin, said primary fins having a base, said primary fins extending from said outer periphery radially inward to said center of said hub portion of said platen, said secondary fin having a first portion, a second portion, and a base, said first portion having a first inner end, said first portion of said secondary fin beginning at said outer periphery of said platen and extending radially inward to said first inner end, said second portion having a second inner end, said second portion beginning at said first inner end and extending to said second inner end, said second portion of said secondary fin having a taper, said taper extending inwardly from said first portion of said secondary fin to said inner surface of said platen.

2. The apparatus of claim 1 wherein said secondary fin is interposed between said first and said second primary fins.

3. The apparatus of claim 1 wherein said first inner end of said secondary fin extends radially inwardly from said outer periphery of said platen to a length between 60% and 90% of said radius R1 of said platen.

4. The apparatus of claim 1 wherein said bottom portion further comprises a tertiary fin, said tertiary fin has a first portion, a second portion, and a base, said first portion having a first inner end, said first portion of said tertiary fin beginning at said outer periphery of said platen and extending radially inward to said first inner end, said second portion having a second inner end, said second portion beginning at said first inner end and extending to said second inner end, said second portion of said tertiary fin having a taper, said taper extending inwardly from said first portion of said tertiary fin to said inner surface of said platen.

5. The apparatus of claim 4 wherein said tertiary fin is interposed between each adjacent pair of said primary and said secondary fins.

6. The apparatus of claim 5 wherein said first inner end of said tertiary fin extends radially inward from said outer periphery of said platen to a length between 40% and 70% percent of said radius R1 of said platen.

7. The apparatus of claim 6 wherein said bases of said primary, secondary, and tertiary fins are radiused.

8. The apparatus of claim 6 wherein said primary, secondary and tertiary fins are spaced apart from each other by a distance equal to, or greater than, the melt layer thickness of the hot melt adhesive.

9. An apparatus used in a system for liquefying and dispensing a hot melt adhesive from a container to a substrate, the apparatus comprising:

a platen, said platen having a top portion, a bottom portion, a center, an outer periphery, an inner surface, a radius R1, and a hub portion, said hub portion located substantially about said center of said platen, said bottom portion having primary fins and secondary fins, said primary fins having a base, said primary fins extending from said outer periphery radially inward to said center of said hub portion of said platen, said secondary fins having a first portion, a second portion, a first sidewall, a second sidewall, and a base, said first portion having a first inner end, said first portion of said secondary fins beginning at said outer periphery of said platen and extending radially inward to said first inner end, said second portion having a second inner end, said second portion beginning at said first inner end and extending to said second inner end, said second portion of said secondary fins having a taper, said taper extending inwardly from said first portion of said secondary fins to said inner surface of said platen, said first sidewall having a first base portion, said first base portion extending from said inner surface of said platen to said top of said second portion of said secondary fins, said first sidewall tapering radially inwardly in both the radial and outward directions.

10. The apparatus of claim 9 wherein said secondary fins are interposed between each pair of adjacent said primary fins.

11. The apparatus of claim 9 wherein said first inner end of said secondary fins extend radially inward from said outer periphery of said platen to a length between sixty (60) and ninety (90) percent of said radius R1 of said platen.

12. The apparatus of claim 11 wherein said tertiary fins have a first portion, a second portion, a first sidewall, a second sidewall and a base, said first portion having a first inner end, said first portion of said tertiary fins beginning at said outer periphery of said platen and extending radially inward to said first inner end, said second portion having a second inner end, said second portion beginning at said first inner end and extending to said second inner end, said second portion of said tertiary fins having a taper, said taper extending inwardly from said first portion of said tertiary fin to said inner surface of said platen.

13. The apparatus of claim 11 wherein said tertiary fins are interposed between each adjacent pair of said primary and said secondary fins.

14. The apparatus of claim 12 wherein said tertiary fins are interposed between each adjacent pair of said primary and said secondary fin.

15. The apparatus of claim 12 wherein said first sidewall of said tertiary fins have a first base portion, said first base portion extending from said inner surface of said platen to said top of said second portion of said tertiary fins, said first sidewall tapering radially inwardly in both the radial and outward directions.

16. The apparatus of claim 12 wherein said first inner end of said tertiary fins extend radially inward from said outer periphery of said platen to a length between 40% and 70% of said radius R1 of said platen.

17. The apparatus of claim 15 wherein said bases of said primary, secondary, and tertiary fins are radiused.

18. The apparatus of claim 12 wherein said primary, secondary and tertiary fins are spaced apart from each other by a distance equal to, or greater than, the melt layer thickness of the hot melt adhesive.

19. The apparatus of claim 1 wherein said platen further comprises a perimeter fins, said perimeter fins extending radially within said platen, said perimeter fins located radially inward along said outer periphery of said platen.

20. The apparatus of claim 9 wherein said platen further comprises a perimeter fins, said perimeter fins extending radially within said platen, said perimeter fins located radially inward along said outer periphery of said platen.

21. The apparatus of claim 19 wherein said platen further comprises a cylindrical sidewall and a pair of elastomeric seals, said cylindrical sidewall having a pair of peripheral grooves, said pair of peripheral grooves able to accept said pair of elastomeric seals, wherein said pair of peripheral grooves nest above said perimeter fins.

22. The apparatus of claim 20 wherein said platen further comprises a cylindrical sidewall and a pair of elastomeric seals, said cylindrical sidewall having a pair of peripheral grooves, said pair of peripheral grooves able to accept said pair of elastomeric seals, wherein said pair of peripheral grooves nest above said perimeter fins.

* * * * *